US010625273B2

(12) United States Patent
David et al.

(10) Patent No.: US 10,625,273 B2
(45) Date of Patent: Apr. 21, 2020

(54) CENTRIFUGE INSERT AND CARRIER FOR CENTRIFUGE INSERT WITH SNAP LOCKING CONNECTION

(71) Applicants: Sandra David, Hamburg (DE); Sylke Grune, Chemnitz (DE)

(72) Inventors: Sandra David, Hamburg (DE); Sylke Grune, Chemnitz (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 14/016,341

(22) Filed: Sep. 3, 2013

(65) Prior Publication Data

US 2014/0179505 A1 Jun. 26, 2014

Related U.S. Application Data

(60) Provisional application No. 61/696,257, filed on Sep. 3, 2012.

(51) Int. Cl.
*B04B 5/04* (2006.01)
*B01L 9/00* (2006.01)

(52) U.S. Cl.
CPC ..... *B04B 5/0421* (2013.01); *B01L 9/523* (2013.01); *B01L 2300/0829* (2013.01); *B04B 2005/0435* (2013.01)

(58) Field of Classification Search
CPC ..... B04B 5/0421; B04B 2005/0435; B01L 9/523; B01L 2300/0829
USPC ..... 494/16, 20
See application file for complete search history.

(56) References Cited

U.S. PATENT DOCUMENTS 6,045,760 A * 4/2000 Aizawa ..... B01L 9/523 422/560
7,211,224 B2 * 5/2007 Olivier ..... 422/534
8,529,847 B2 * 9/2013 Arras ..... G01N 35/04 215/237
2002/0006361 A1 * 1/2002 Sanadi ..... B01L 3/5025 422/400
2002/0072112 A1 * 6/2002 Atwood et al. ..... 435/303.1
2004/0184968 A1 9/2004 Aschettino et al.
2007/0031282 A1 * 2/2007 Zucchelli ..... B01L 3/5025 422/400
2010/0151511 A1 * 6/2010 Greenizen ..... B01L 3/5085 435/40.5

(Continued)

FOREIGN PATENT DOCUMENTS

DE 199 53 453 C2 5/2001
WO WO 01 60519 A1 8/2001

(Continued)

*Primary Examiner* — Charles Cooley
(74) *Attorney, Agent, or Firm* — Von Rohrscheidt Patents

(57) ABSTRACT

A centrifuge insert for sample receivers and to a carrier for a centrifuge insert for sample receivers with snap locking connection. The centrifuge insert according to the invention has substantial advantages over known centrifuge inserts. These advantages are not limited to the fact that the carrier is attachable and disengageable in a particularly easy and comfortable manner. It is also feasible to use various carriers for different sample receivers. Furthermore, the centrifuge insert according to the invention is configured particularly light and compact so that a loading of the rotor is significantly lower for identical centrifugation powers or so that significantly higher RCA values can be used.

10 Claims, 7 Drawing Sheets

(56) References Cited

U.S. PATENT DOCUMENTS

| | | | | |
|---|---|---|---|---|
| 2010/0184578 | A1* | 7/2010 | Piramoon et al. | 494/20 |
| 2014/0179505 | A1* | 6/2014 | David | B04B 5/0421 494/20 |
| 2014/0193312 | A1* | 7/2014 | Hoyer | B01L 9/523 422/509 |
| 2019/0151862 | A1* | 5/2019 | Goellnitz | B01L 9/523 |

FOREIGN PATENT DOCUMENTS

| | | | | |
|---|---|---|---|---|
| WO | WO 2010106147 | A1 * | 9/2010 | B01L 9/523 |
| WO | WO 2012 057548 | A2 | 5/2012 | |

* cited by examiner

CENTRIFUGE INSERT AND CARRIER FOR CENTRIFUGE INSERT WITH SNAP LOCKING CONNECTION

RELATED APPLICATIONS

This application claims priority from and incorporates by reference U.S. provisional patent application 61/696,257, filed on Sep. 3, 2012.

FIELD OF THE INVENTION

The present invention relates to centrifuge insert for sample holders.

BACKGROUND OF THE INVENTION

Centrifuge inserts of this type are known for various sample holders like micro titer plates, deep well plates, PCR (polymerase chain reaction) plates, and cell culture plates in different configurations.

For example, DE 199 53 453 C2 describes a bucket shaped centrifuge insert (centrifuge bucket) for micro titer plates which is attached at a centrifuge rotor as a micro titer pivot. This centrifuge insert includes a carrier which is inserted into the base of the centrifuge insert. The carrier is a micro titer plate carrier that is insertable into the centrifuge insert, wherein the micro titer plate carrier can be removed from the centrifuge insert through retaining tabs.

It is a disadvantage of the bucket shaped centrifuge inserts of this type that they always have to be provided with an extraction or placement aid for the sample holders since sample holders can otherwise not be inserted or removed. Furthermore, centrifuge buckets are relatively heavy through their configuration that is closed towards the sides which requires limiting a maximum permissible speed of rotation or of the RCA (relative centrifugal acceleration) values in order to prevent excessive loading of the rotor.

In order to provide improvements, open centrifuge inserts were already described which are for example offered by Eppendorf AG under the name "flex suspensions". These centrifuge inserts do not include circumferentially closed sidewalls. They have a significant weight advantage over centrifuge buckets and can therefore be used in faster spinning centrifuges. Furthermore, extraction aids are not required since the sample holders can be removed or inserted by hand. Additionally, a bolted down carrier is required at the base of the centrifuge insert for the sample holders, wherein the bolted down carrier is used for exact positioning and also for fixation of the sample holders so that the sample holders cannot fall out of the centrifuge insert when the centrifuge swings out. This carrier is also used for damping the sample holder. These damping properties are already known from the extraction aids for centrifuge buckets that are provided with a damping support. A separate fixation of the sample holders in the extraction aids is not required since the fixation is already provided through the side walls of the centrifuge buckets. Overall, this yields significant weight savings for the open centrifuge inserts over the bucket shaped centrifuge inserts.

It is a disadvantage of the known open centrifuge inserts that a bolted down fixated carrier at least renders cleaning the centrifuge insert very difficult. Furthermore, known carriers are configured so that all feasible sample holders, such as PCR plates, micro titer plates, deep well plates and cell culture plates can be placed on these known carriers. Thus, they have to be equally suitable for all plates in the sense of a "greatest common denominator" and thus have no geometry that is adapted or optimized for a particular type of plate.

BRIEF SUMMARY OF THE INVENTION

Thus, it is an object of the present invention to provide a centrifuge insert which provides easy cleaning and adaptability to various sample holders. In particular, a centrifuge insert shall also be provided through which the loading of the rotor remains relatively small or high RCA values can be used.

This object is achieved through a centrifuge insert for sample holders like micro titer plates, deep well plates, PCR plates and cell culture plates, the centrifuge insert including a body with a base and with at least one support for attaching the centrifuge insert to a rotor, wherein a carrier is detachably arranged at the base, wherein the carrier includes a base surface for receiving sample holders, wherein the carrier is attached at the body through a connection that is detachable without tools.

The object is also achieved by a carrier for the centrifuge insert for the sample holders like micro titer plates, deep well plates, PCR plates and cell culture plates, wherein the centrifuge insert includes the body with the base and the at least one support for attaching the centrifuge insert to the rotor, wherein the carrier is detachably arranged at the base of the centrifuge insert and includes a base surface for receiving the sample holders, wherein the carrier includes features specific to the carrier described supra. Advantageous embodiments are provided in the dependent claims.

The inventors have found that the object can be achieved in a particularly simple and cost effective manner in that an attachment is provided between the carrier and the centrifuge insert which can be disengaged without tools. An attachment that can be disengaged without tools means in this context that a user does not need any specially configured tools, but that the carrier can be disengaged simply by hand or optionally using a ball pen or other hard objects.

The configuration according to the invention still provides a secure fixation of the sample holders on the centrifuge insert. Since the carrier is attached in the centrifuge insert so that it is easily detachable by the user at any time, it is possible on the one hand side to configure the carrier as an adapter for various sample holders for various sample containers so that it is easily exchangeable when necessary. Thus, the carrier can be configured for fixating for example one or more micro titer plates, deep well plates, PCR plates, or cell culture plates in place. On the other hand side, the carriers can be quickly replaced without any problems when wear occurs. Also cleaning the carrier and the centrifuge insert is facilitated through the detachable connection which increases service life.

In a particularly preferred embodiment, the detachable connection is provided through at least one clip connection between carrier and body of the centrifuge insert. A clip connection of this type can be used very comfortably by the user during attaching and also during detaching. Contrary to bolted connections, a clip connection of this type has the advantage that lower forces are generated at the joint during centrifugation so that the wear of the carrier is lower. Furthermore, additional savings in material are feasible at the carrier as well as at the centrifuge insert since a critical mass of material that facilitates the bolted connection does not have to be provided anymore. This has the consequence that the carrier and the centrifuge insert can be configured lighter so that higher centrifugation speeds can be implemented.

Attaching the carrier with a single support can be provided for example in that the base of the carrier includes an element that can be clipped in, wherein the element corresponds with a respective receiver in the base of the centrifuge insert and permeates the centrifuge insert. When this element that can be clipped in is not configured rotationally symmetric, then a complete position fixation of the carrier relative to the centrifuge insert is provided.

In an advantageous embodiment of the clip connection, at least one snap hook is arranged at the carrier which engages a corresponding recess of the body, wherein the snap hook is preferably laterally arranged at the carrier and extends substantially vertically with respect to the base of the centrifuge insert. Thus, the clip connection can be build up in a particularly simple constructive manner. In particular, the recess is designed as an opening, whereby the snap hook can be easily pressed out of the recess by the user. This flexibility of the snap hook is a result of its dimensioning. Alternatively or additionally, it can also be provided that the recess is arranged at a flexible element of the carrier, so that the recess can be spaced apart from a corresponding snap hook so that the snap hook does not engage the recess anymore. Alternatively, it can also be provided that the elastic element is arranged at the body and the substantially stiff element is arranged at the carrier.

In an advantageous embodiment, it can be provided that the snap hook is configured as a retaining tab, which is configured angled inwards at its end that faces away from the base surface. Thus, for example several micro titer plates, stacked on top of each other, can be held securely on the carrier, the retaining tabs are simultaneously used as supports for the carrier and the clip connection can be disengaged through pressing the retaining tabs inwards. In this case, it would also be possible that the corresponding recesses at the centrifuge insert are not configured as openings.

In an advantageous embodiment the elastic snap hook is arranged at an interior side of the corresponding opening of the body wherein the interior side is oriented towards a center of the base surface and the elastic snap hook is under an outwardly directed preload towards the interior side of the corresponding opening of the body and directed away from the center of the base surface when the elastic snap hook is engaged with the corresponding opening of the body, wherein the elastic snap hook terminates within the corresponding opening and does not protrude beyond the body in the direction that is oriented away from the center of the base surface when the elastic snap hook is engaged with the corresponding opening of the body.

Advantageously, the detachable connection is arranged in swing out direction of the centrifuge insert which facilitates particularly safe and firm connection of the carrier at the centrifuge insert. Additionally, it can certainly also be provided that a detachable connection is provided vertical to the swing out direction in order to fixate the carrier on the centrifuge insert on all sides.

It is particularly advantageous when the centrifuge insert is configured at least rounded in portions in a plane perpendicular to the swing out direction. In particular for this purpose, the support of the centrifuge insert at the rotor is configured rounded at the bottom. Thus, the mass is additionally reduced. Furthermore, the centrifuge insert configured in this way has a lower flow resistance in swing out direction and turbulences are prevented through the rounded configurations.

In particular in this context it is useful when at least one stiffening element is arranged at a side of the base that is oriented away from the support, wherein the stiffening element is preferably configured as a rib or as a bar. Thus, the centrifuge insert can be kept sufficiently stiff also where the material is weakened through the rounding. Advantageously, the stiffening element shall also be configured rounded in a direction perpendicular to the swing out direction in order to keep the mass low and to possibly minimize air resistance and prevent turbulences.

Advantageously, plural stiffening elements are provided, wherein preferably at least two stiffening elements are arranged perpendicular to one another with respect to the base. This leads to an overlap of the stiffening elements which causes a particularly strong stiffening. This configuration further facilitates light weight construction of the centrifuge insert, wherein energy consumption is reduced due to the reduced mass or higher centrifugation speeds are facilitated.

It is particular advantageous when at least the base surface of the carrier is configured partially elastic because loads generated during centrifugation are dampened by the received sample holders in particular during spin out and spin back. This can be achieved for example through an applied elastic material.

In a particularly preferred embodiment, it is provided that at least one hollow space extends below the base surface of the carrier, whereby on the one hand side, the carrier can be configured even lighter. On the other hand side, the loads are transferred into the base in a particularly favorable manner during centrifugation.

In this context, it is useful when a support structure is arranged in the hollow space for supporting the base surface relative to the base. This effectively prevents yielding of the base surface and in particular a punctiform yielding which could lead to a deformation of the sample holders. The support structure is advantageously configured stiff for this purpose.

Furthermore, it is highly advantageous when the density of the points of support (points of support per surface area) of the carrier on the base is higher at the edge regions than in the center of the base because the loads are then transferred in an increased manner in the edge regions into the base, so that the loading in the relatively weaker center of the base is reduced.

Independent patent protection is claimed for such carrier for a centrifuge insert for sample holders which is attachable in the centrifuge insert so that it can be detached without tools.

BRIEF DESCRIPTION OF THE DRAWINGS

The features and further advantages of the present invention are now described in more detail based on an advantageous embodiment with reference to drawing figures, wherein:

FIGS. 1 and 3 illustrate the centrifuge insert 1 according to the invention in various schematic views.

DETAILED DESCRIPTION OF THE INVENTION

Figure 1:
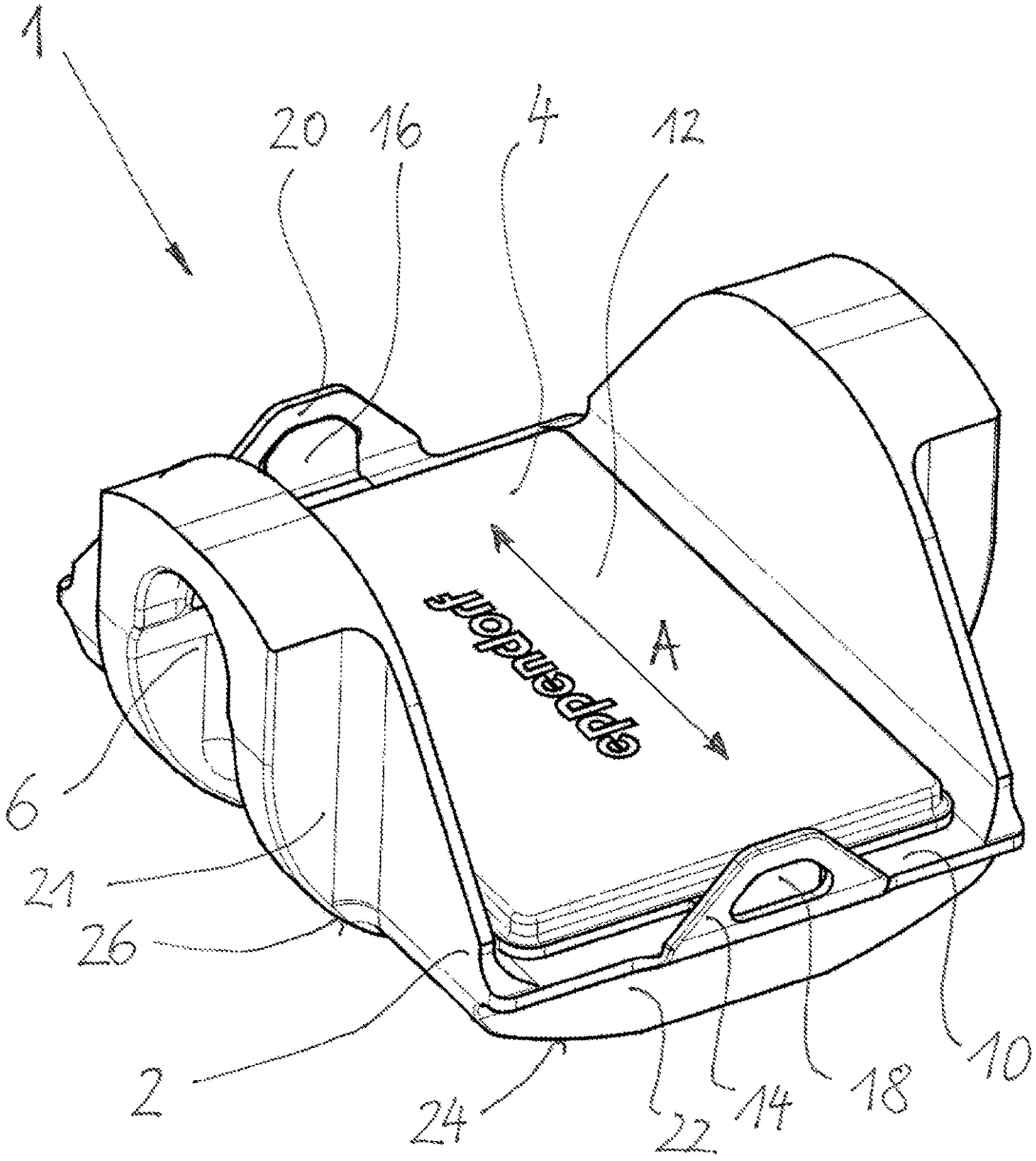
FIG. 1 illustrates a perspective view of the centrifuge insert according to the invention.
Figure 2:
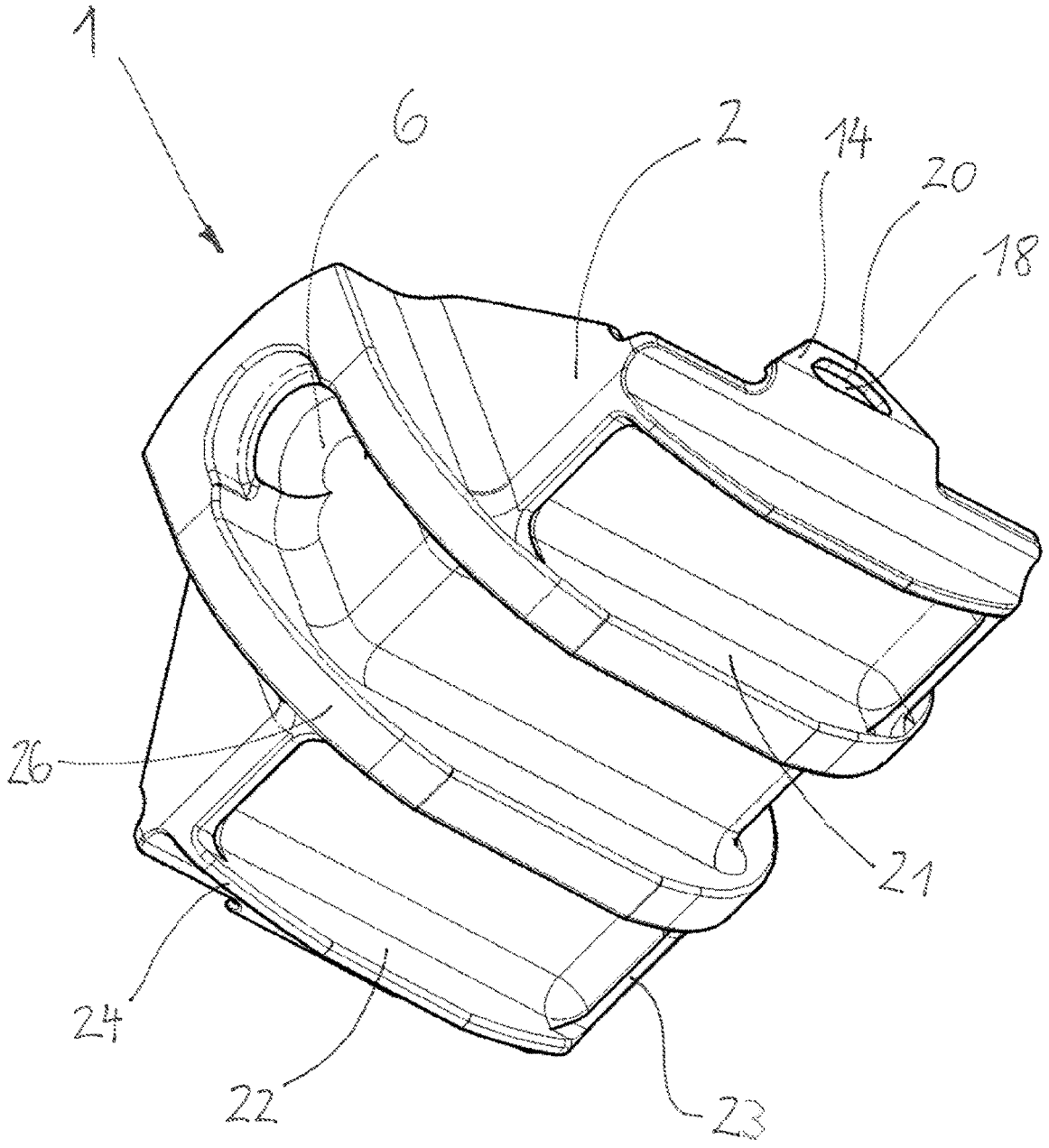
FIG. 2 illustrates the centrifuge insert according to the invention according to FIG. 1 in a view from below.

It is apparent that the centrifuge insert includes a body 2 and a carrier 4 for the sample holder. Furthermore, two supports 6 for attaching at the rotor 59 of the centrifuge 50 are provided so that the centrifuge insert 1 is a centrifuge insert that can swing out. Furthermore it is apparent that the carrier 4 is arranged at a base 10 of the body 2 and includes a continuous closed base surface 12 that has at least the size of the sample holder in a top view and on which the sample holder 61 is arranged. Clip connections 14 are provided for a detachable connection of the carrier 4 on the base 10. For this purpose, the carrier 4 includes two snap hooks 16 that are arranged opposite to one another; which engage into the openings 18 which are arranged at retaining tabs 20 of the body 2. It is apparent that the retaining tabs 20 extend essentially vertical from the base 10 of the body 2. The snap hooks 16 are arranged at a lateral extension 16*a* of the carrier 4 and have a curvature 16*b* and a section 16*c* connecting therewith that is essentially vertically oriented, wherein the extension 16*a* and the section 16*c* have less material thickness than the lateral extension 16*a*. Thus, the snap hook gets a certain amount of flexibility so that it can be disengaged from the opening 18 by a user reaching through the opening 18. Optionally, the user can use an auxiliary device like a ball pen or similar instead of his finger when larger forces are required. Arresting the snap hook relative to the opening 18 is performed through the substantially horizontally extending hook element 16*d*.

The centrifuge insert 1 is configured in light weight construction with relatively small material thickness and for example made from aluminum which is familiar to a person skilled in the art. In order to stiffen the body 2, bars 21, 22 perpendicular to the swing out direction A and bars 23 parallel to the swing out direction A are arranged at a bottom side of the centrifuge insert 1, wherein the bars intersect one another. The bars 22 thus include lateral roundings 24 so that the weight is reduced and the air flow resistance of the centrifuge insert 1 in swing out direction A is reduced. Additionally, this bar 22 can also be configured beveled. Also the support 6 with its bars 21 includes a rounding 26 at its base, which also reduces air flow resistance and additionally reduces the weight of the centrifuge insert 1. Thus, overall the centrifuge insert is configured very light weight and compact, wherein the bars 21, 22, 23 still provide sufficient stiffness also under high loads, so that the base 10 cannot bend. The bars 21 bear the main load and pass it to the support 6 and the bars 22 stiffen the base 10 on the outside so that it doesn't kink out under high loads.

Thereby, the clip connections 14 are arranged opposite to one another in swing out direction A which provides a particularly secure and fixated attachment of the carrier 4 at the body 2. Additionally, clip connections can also be provided between the carrier 4 and the support 6 so that unilateral fixation is provided at the body 2, this however is not mandatory.

Figure 3:
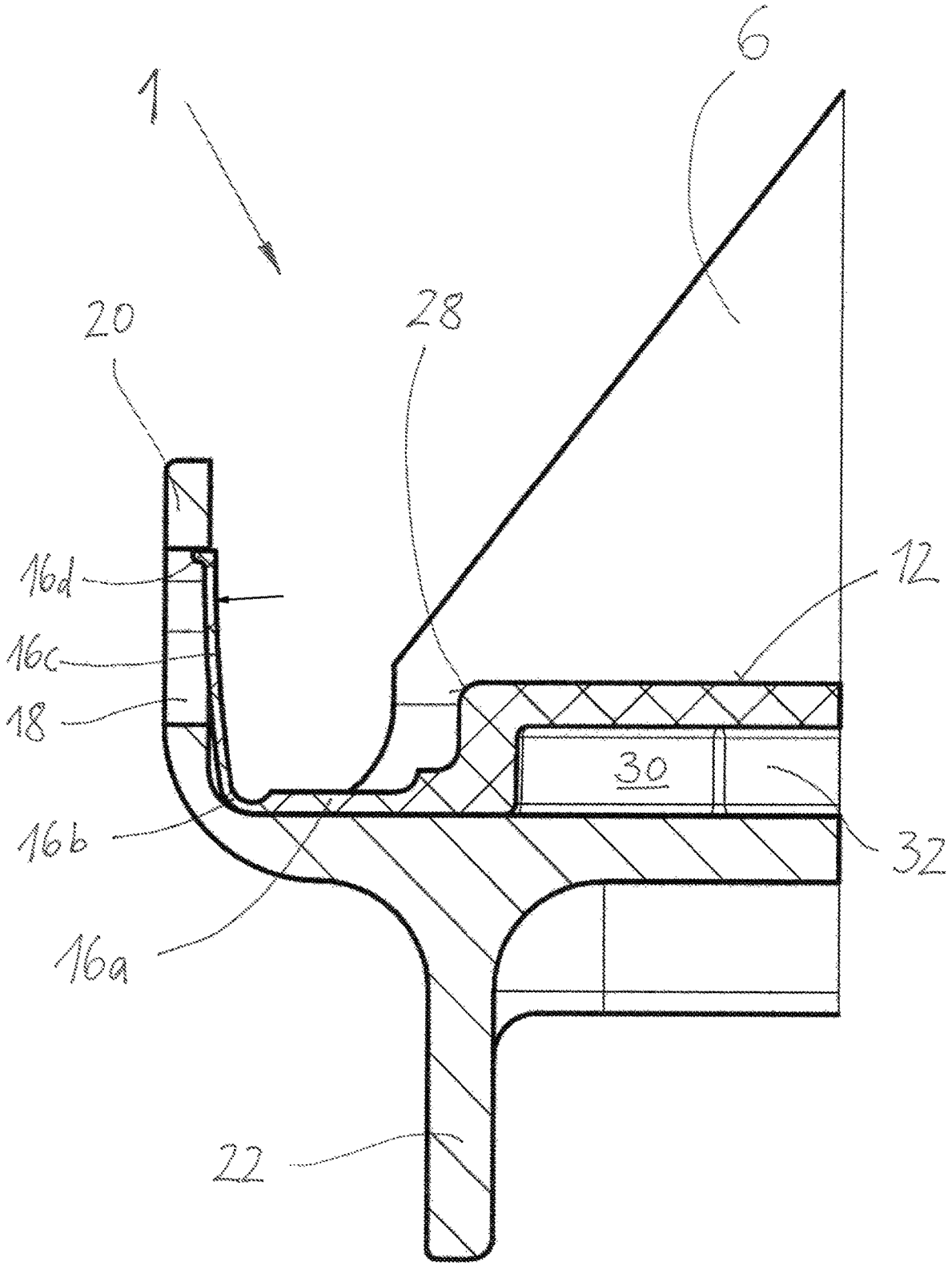
FIG. 3 illustrates a cutout of the centrifuge insert according to FIG. 1 in a sectional view.
Figure 4A:
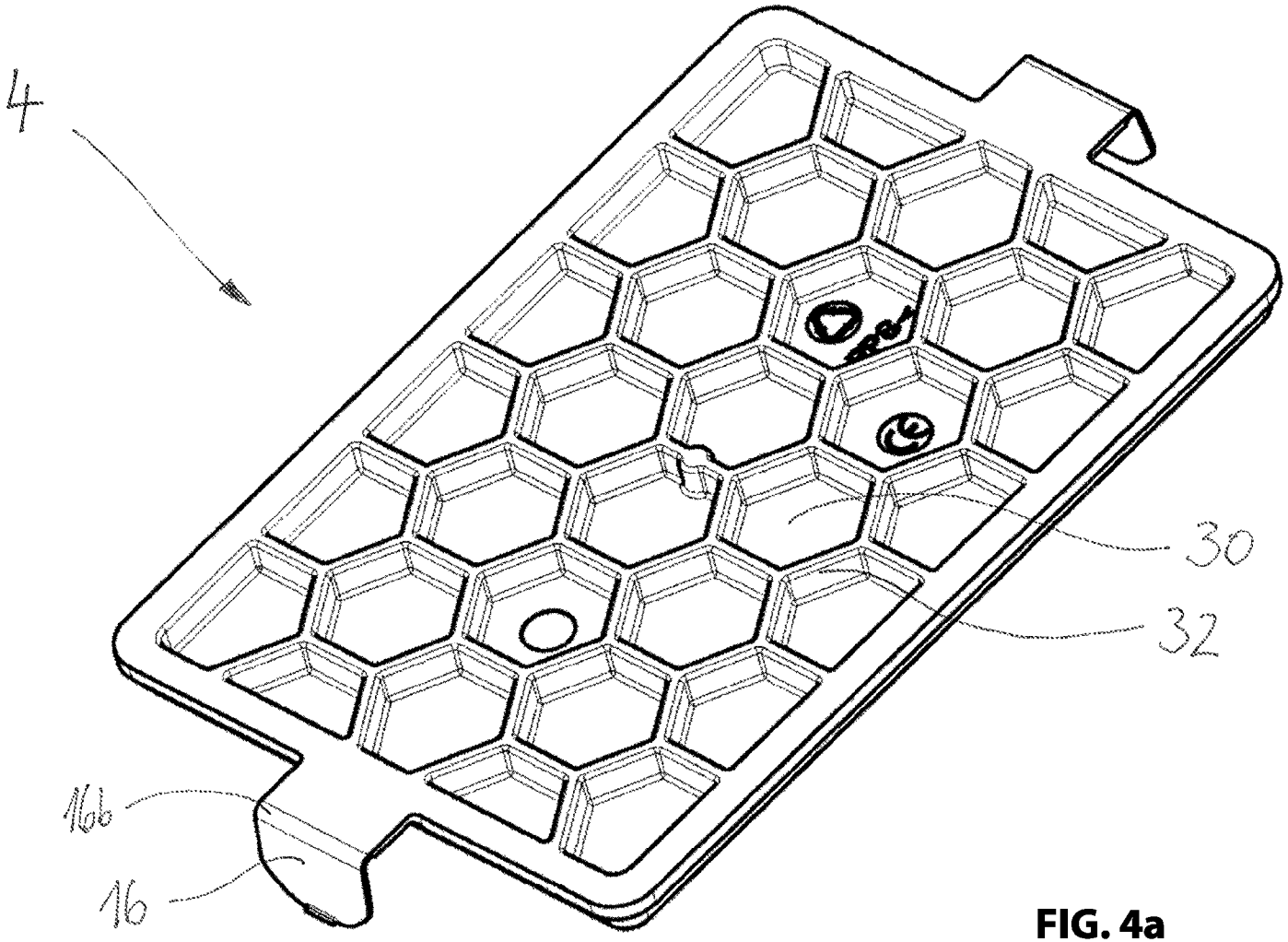
FIGS. 4*a, b* illustrate the carrier according to the invention in a perspective view from below and in a sectional view.
Figure 4B:
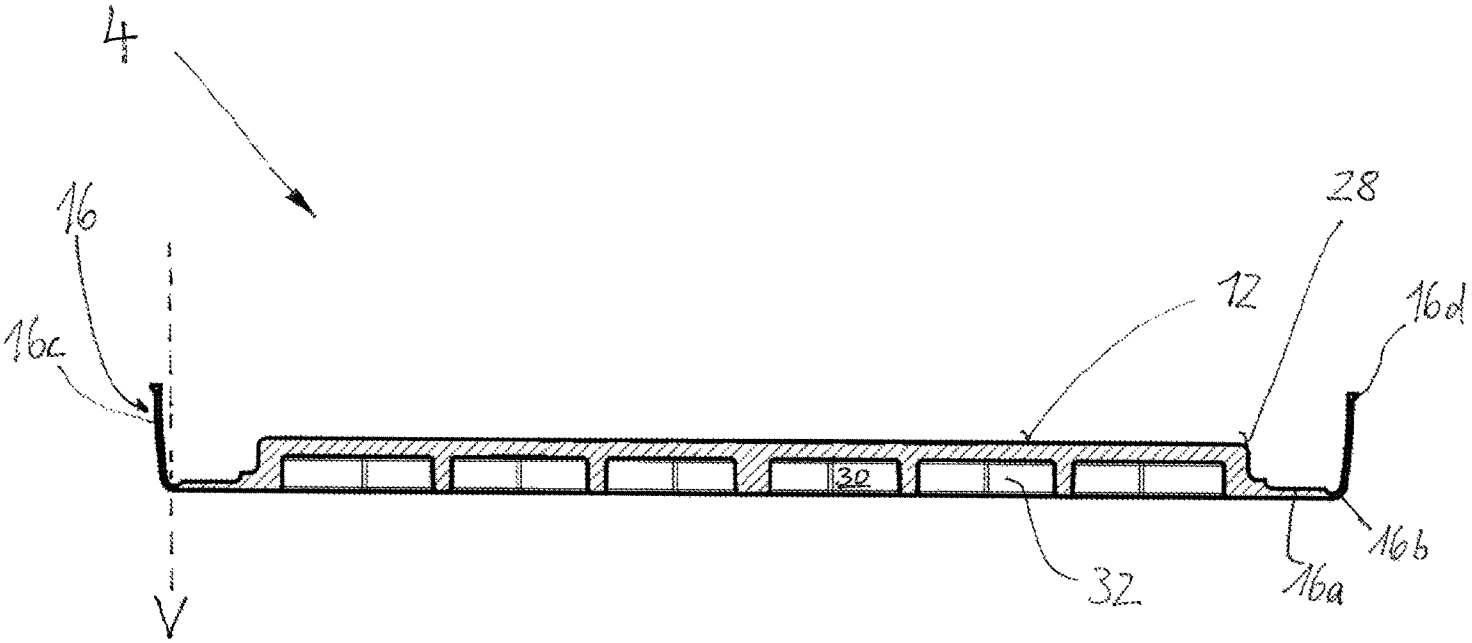

The particular configuration of the carrier 4 according to the invention is apparent from FIGS. 3 through 4*b*.

It is apparent that the carrier 4 includes a step 28 that is arranged between the base surface 12 and the lateral extension 16*a*, wherein the step extends around the carrier 4. This step 28 is used for fixating the micro titer plates 61 which include a corresponding circumferential edge which is inserted onto the step 28. Thus, the micro titer plates 61 are fixated directly at the carrier 4 and do not touch the clip connection 14 or the supports 6. In case no micro titer plates 61 shall be used, but other sample holders (not illustrated), particularly adapted carriers (not illustrated) can be used for this purpose.

The snap hook 16 has a position that is laterally tilted outward relative to a vertical V. This yields a preload of the snap hook 16 relative to the ear 20 so that the hook element 16*d* is safely fixated in the cutout 18, but can be disengaged again when the preload is overcome. The snap hook 16 engages the corresponding recess 18 of the body 2 from an inside of the body 2.

The base surface 12 of the carrier 4 is arranged elevated relative to the base 10 of the centrifuge insert 1, so that cavities 30 are provided which are arranged honeycomb shaped. Stiff supports 32 are arranged between the cavities 30. Thus, the base surface 12 achieves a high level of stiffness, wherein a defined force is introduced into the base 10. The base surface 12 is provided with a flexible support (not illustrated) in order to receive load peaks that occur during centrifugation. Additionally it can also be provided that the honeycomb structure is increased in size towards the center of the base surface 12, so that a density of the contact points of the carrier 4 at the base 10 is greater at an edge than in a center of the base 10 so that loads are increasingly introduced into the base 10 at the edge, so that a loading in the center of the base 10 which is configured relatively weaker is reduced. The support structure formed from the stiff supports 32 extends from the base surface 12 to the base 10 and contacts the base 10 in contact areas that are distributed over the base in a uniform pattern.

Figure 5A:
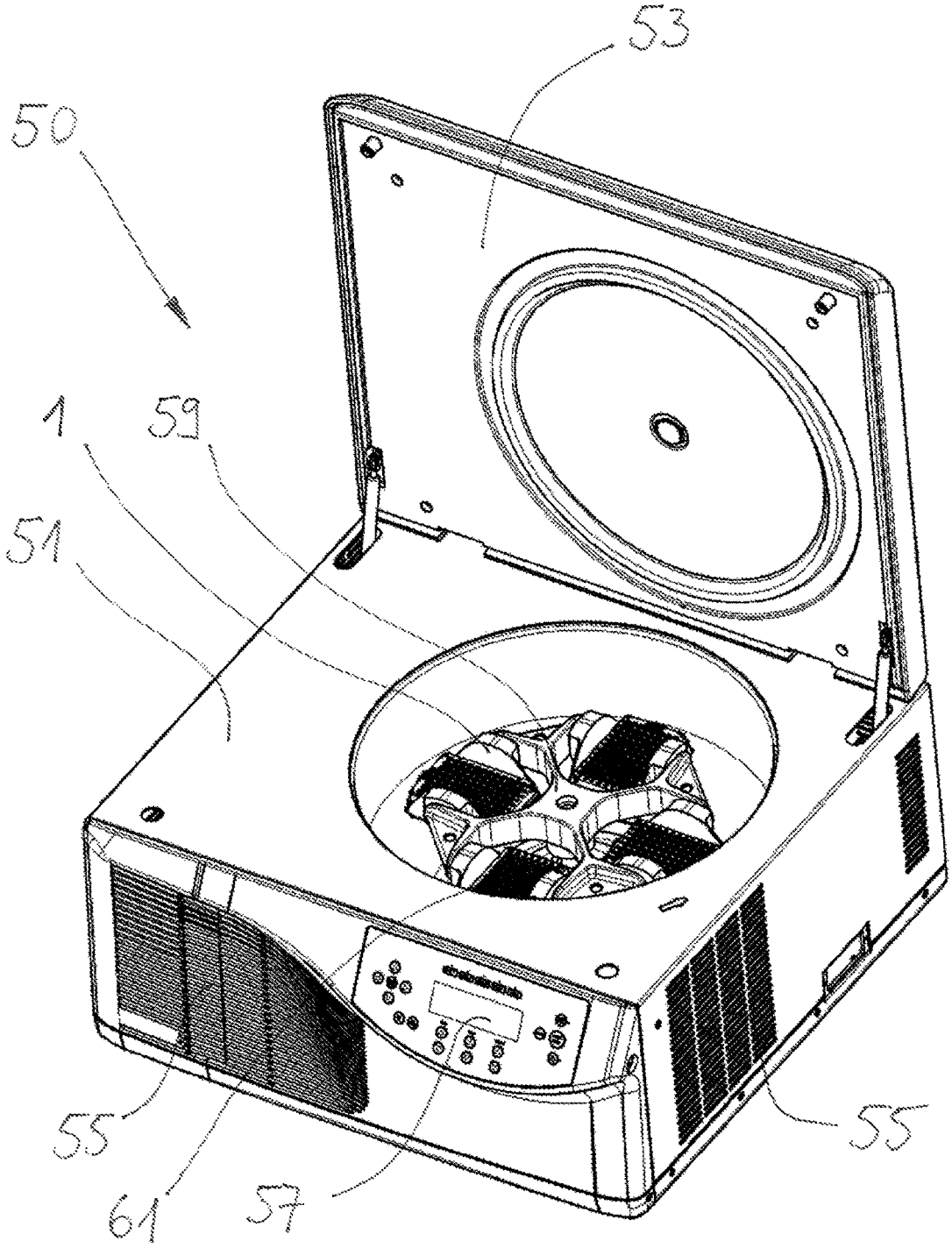
FIGS. 5*a, b* illustrate the centrifuge insert according to FIG. 1 in interaction with a centrifuge and an inserted micro titer plate in an overall view and in a detail view.
Figure 5B:
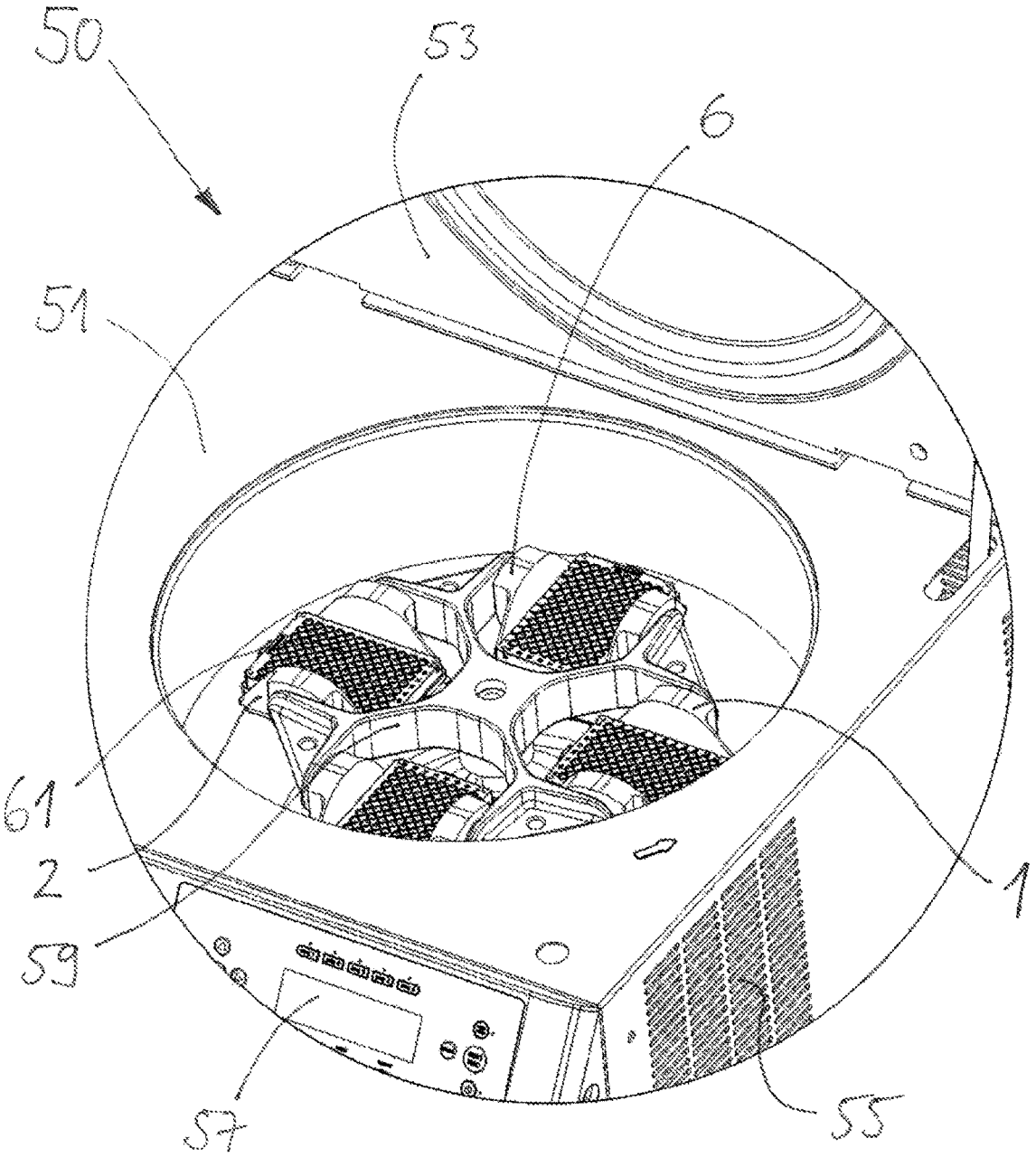

FIG. 5*a* and the corresponding partially enlarged view in FIG. 5*b* illustrate an interaction of the centrifuge insert 1 according to the invention with a centrifuge 50 which includes a centrifuge housing 51 with a centrifuge cover 53 and ventilation slots 55 and an operating unit 57. It is apparent that the centrifuge insert 1 is arranged at a rotor 59 with its support 6 so it can swing out, wherein the rotor 59 is provided to receive four centrifuge inserts 1 and a sample holder 61 that is configured as a micro titer plate is arranged on each centrifuge insert 1.

It is apparent from the preceding descriptions that the centrifuge insert 1 according to the invention provides significant advantages over the known centrifuge insert. These are not limited to the fact that the carrier 4 can be attached and detached again particularly easily and comfortably. It is also feasible to use different carriers 4 for different sample holders 61. Furthermore, the centrifuge insert 1 is configured particularly light and compact, so that the load of the rotor 59 is provided significantly smaller for identical centrifugation performance or so that significantly higher RCA values are achievable.

What is claimed is:

1. A centrifuge insert for sample holders, the centrifuge insert comprising:

a body including an interior with a base; and at least one support for pivotably attaching the centrifuge insert to a rotor, wherein a carrier is detachably arranged at the base, wherein the carrier includes a base surface for receiving one or more sample holders respectively including plural sample containers, wherein the base surface has at least a size of the sample holder in a top view, wherein the carrier is fixed at the body of the centrifuge insert through at least one clip connection that is detachable without tools, wherein an elastic snap hook is laterally arranged at the carrier, wherein the elastic snap hook engages a corresponding opening of the body and extends with a lateral outward tilt with reference to a plane that is vertical to the base surface when engaging the corresponding opening of the body, wherein the elastic snap hook is arranged at an interior side of the corresponding opening of the body wherein the interior side is oriented towards a center of the base surface and the elastic snap hook is under an outwardly directed preload towards the interior side of the corresponding opening of the body and directed away from the center of the base surface when the elastic snap hook is engaged with the corresponding opening of the body, wherein the elastic snap hook terminates within the corresponding opening and does not protrude beyond the body in the direction that is oriented away from the center of the base surface when the elastic snap hook is engaged with the corresponding opening of the body, wherein the corresponding opening extends in the plane that is vertical to the base surface, wherein the elastic snap hook snaps into the corresponding opening of the body in a direction that is within a horizontal plane of the base surface and oriented away from the center of the base surface, wherein the elastic snap hook is elastic in the direction that is within the horizontal plane of the base surface, and wherein the elastic snap hook is accessible in the horizontal plane of the base surface through the corresponding opening in a direction that is within the horizontal plane of the base surface and oriented towards the center of the base surface and pressable in the horizontal plane of the base to pivot out of the corresponding opening and towards the center of the base surface so that the snap hook is disengageable from the corresponding opening.

2. The centrifuge insert according to claim 1, wherein the detachable connection is arranged in swing out direction of the centrifuge insert.

3. The centrifuge insert according to claim 1, wherein the centrifuge insert is configured rounded at least in portions in a plane perpendicular to a swing out direction, and wherein the support is configured rounded at a base side.

4. The centrifuge insert according to claim 1, wherein at least one stiffening element is arranged at least at a side of the base that is oriented away from the carrier, and wherein the at least one stiffening element is configured as a rib or as a bar, which is configured rounded at least perpendicular to the swing out direction.

5. The centrifuge insert according to claim 4, wherein plural stiffening elements are provided, and wherein at least two stiffening elements are arranged perpendicular to one another with respect to the base.

6. The centrifuge insert according to claim 1, wherein at least the base surface of the carrier is configured at least partially elastic.

7. The centrifuge insert according to claim 1, wherein at least one hollow space extends below the base surface, wherein a support structure is arranged in the hollow space and supports the base surface relative to the base, and wherein the support structure extends from the base surface to the base and contacts the base in contact areas that are distributed over the base in a uniform pattern.

8. The centrifuge insert according to claim 1, wherein the carrier is configured for positional fixation of one or more micro titer plates, deep well plates, PCR plates or cell culture plates.

9. The centrifuge insert according to claim 1, wherein the sample holders are micro titer plates, deep well plates, PCR plates or cell culture plates.

10. The centrifuge insert according to claim 1, wherein the base surface is continuous and closed.

* * * * *